United States Patent [19]

Allen

[11] 4,453,274

[45] Jun. 12, 1984

[54] ATHLETIC UPPER-BODY GARMENT

[76] Inventor: William R. Allen, 625 College Dr., Reno, Nev. 89503

[21] Appl. No.: 488,726

[22] Filed: Apr. 26, 1983

[51] Int. Cl.[3] ..... A41D 1/04; A41B 1/00

[52] U.S. Cl. ..... 2/102; 2/115

[58] Field of Search ..... 2/102, 109, 110, 111, 2/112, 113, 67, 115, 104; 128/460

[56] References Cited

U.S. PATENT DOCUMENTS

| | | | |
|---|---|---|---|
| 2,890,460 | 6/1959 | Levi | 2/115 |
| 3,611,439 | 10/1971 | Meyers | 2/104 |
| 4,078,265 | 3/1978 | Condit | 2/115 |

*Primary Examiner*—Doris L. Troutman

*Attorney, Agent, or Firm*—Harvey B. Jacobson

[57] ABSTRACT

An upper-body garment, such as an athletic jersey, has a facility whereby its characteristic color may be changed so that a wearer while participating in a team sport may switch teams without having to change jerseys. The garment has an inner shell and an outer shell. The outer shell comprises front and rear panels having one color on the outside and another color on the inside which is the same as the color of the inner shell. The panels may be attached together over the shoulders when the one color is to be exposed, and the panels may be detached so as to hang down from a midriff section of the garment when the other color is to be exposed.

10 Claims, 7 Drawing Figures

ATHLETIC UPPER-BODY GARMENT

BACKGROUND OF THE INVENTION

It is desirable when practicing sports where one team plays against another, to be able to distinguish as between players of the respective teams. Commonly, this is accomplished by dressing the teams in distinguishable garments, generally athletic jerseys, T-shirts, singlets or the like, the most common form of distinction being by way of color. When, therefore, a player moves from one team to the other, it is generally necessary to change garments.

A previous proposal for avoiding the necessity of changing garments when switching from one team to another, is disclosed, for example, in U.S. Pat. No. 4,078,265. This patent shows a T-shirt having an elongated flap which can be moved from a position covering the front of the shirt to a position covering the rear of the shirt, and with the flap having distinguishable color characteristics on the front and rear. However, when the exterior color of the shirt is to be changed, it is necessary to detach the lower end of the flap and swing the flap over the wearer's head. Further, the flap does not fully conceal the color of the shirt itself.

The present invention provides an improved garment which can be converted into alternative appearances by a wearer, without having to remove the garment or raise any portions thereof over his or her head.

SUMMARY OF THE INVENTION

Broadly stated, the invention provides an athletic upper-body garment having inner and outer shells for embracing a shoulder, back, and chest area of a wearer, the shells being integrated around a midriff section of the garment, the outer shell comprising a front panel and a rear panel, the panels being movable between a raised position wherein the panels substantially cover the inner shell and a lowered position wherein the panels hang down from the midriff section of the garment. With the panels in the raised position, the garment may present a first characteristic outer surface appearance due to the outer surface of the panels, for example, being formed in a first color, and with the panels in the lowered position, the garment may present a second characteristic outer surface appearance, for example, by the panel surfaces which were previously intermost, as well as the outer surface of the inner shell, being formed in a second characteristic color. The garment includes means for releasably securing the panels in the raised position, for example, the panels may be separated at the respective shoulder portions thereof and may be provided with means for releasably attaching the shoulder portions together over the shoulders of a wearer. Further, the garment may include an integral lower portion depending from the midriff section, the lower portion presenting an outer surface appearance corresponding to the outer surface appearance of the panels when in the raised position.

Thus it will be seen, that the invention provides an athletic garment which may readily have its overall appearance, e.g. color, changed without a wearer having to remove the garment or swing any portion thereof over his or her head. In order to change the appearance of the garment, it is merely necessary either to release and lower the front and rear panels or, alternatively, to raise an secure the respective panels.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
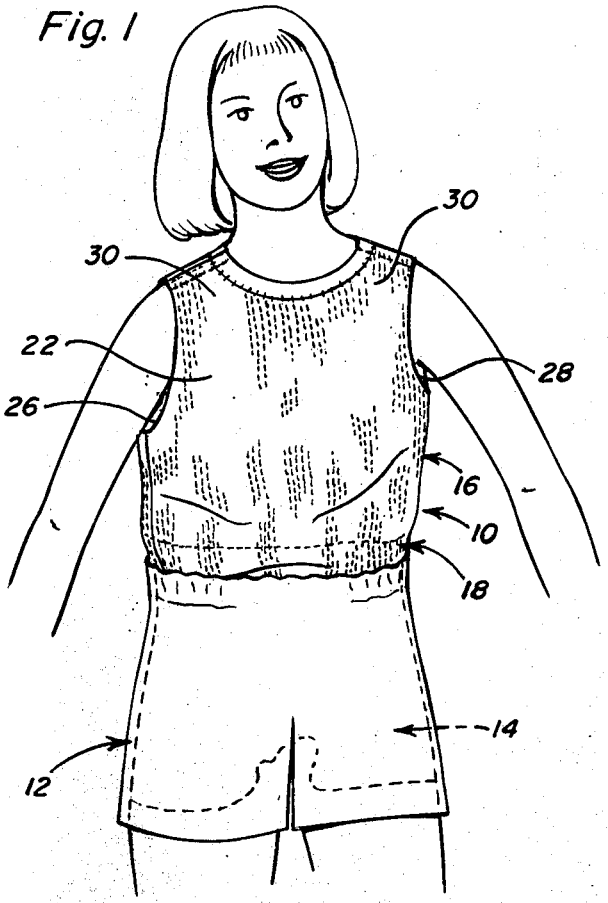
FIG. 1 is partly schematic view of an athlete wearing shorts and an athletic jersey in accordance with the invention, the jersey being shown in a first orientation of its respective parts.

FIG. 1 of the drawings shows an athlete wearing athletic shorts 12 and an upper-body garment 10 in the form of an athletic jersey in accordance with the invention. The jersey includes a lower portion 14 (see also FIG. 3) and which, in FIG. 1, is tucked into the wearer's shorts, and an upper portion 16 embracing a shoulder, chest, and back area of the wearer. The upper and lower portions join at a midriff section 18 of the jersey.

As shown in FIG. 1, the outer surface of the jersey has a characteristic overall first color, for example, white. However, if the athlete is participating in a team sport, if may be desirable to change colors in order to switch teams. The illustrated jersey provides this facility, as will be described, without having to remove the jersey or swing any part thereof over the wearer's head.

Figure 2:
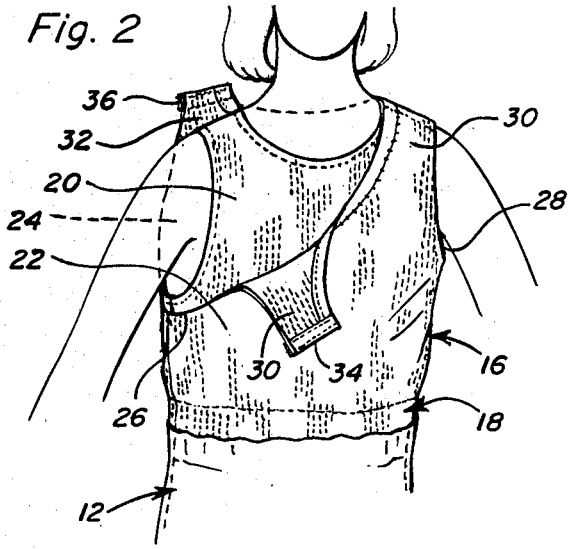
FIG. 2 is a view similar to FIG. 1 illustrating the manner in which the jersey may be converted to a second orientation of its parts, in order to change its overall appearance.
Figure 6:
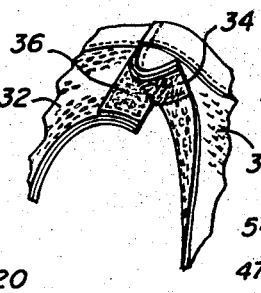
FIG. 6 is a fragmental perspective view of a shoulder portion of the jersey.
Figure 7:
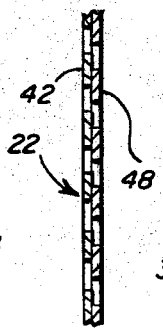
FIG. 7 is a detailed sectional view on line 7—7 of FIG. 3.
Figure 4:
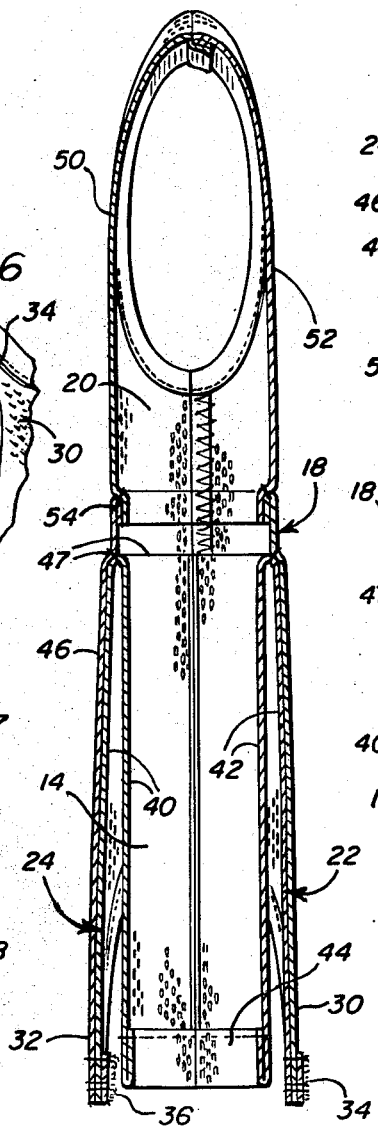
FIG. 4 is a sectional view on line 4—4 of FIG. 3.
Figure 5:
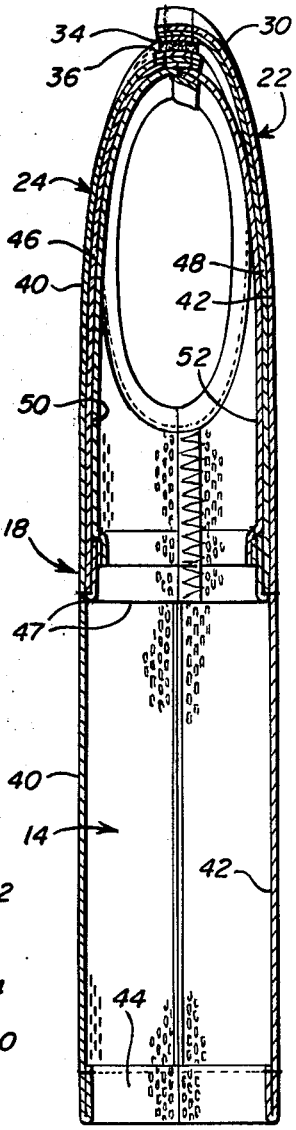
FIG. 5 is a view similar to FIG. 4 but showing the jersey in its first orientation.

Thus, as seen in FIG. 2, the upper portion 16 of the jersey comprises an inner shell 20 and an outer shell having a front panel 22 and a rear panel 24. The front and rear panels may be integrated up to the bottoms of respective armhole openings 26, 28 but the panels terminate in separated shoulder portions 30, 32. The shoulder portions are provided with respective releasable securing means in the form of "Velcro" tabs 34, 36 (see FIGS. 2, 3 and 6). The integrated lower end of the front and rear panels is joined to inner shell 20 and to lower portions 14 of the jersey around the midriff section, as will be described. The inner surfaces of panels 22 and 24 (as seen in FIGS. 1 and 2) have the same color, for example, blue as the outer surface of shell 20, this color being different to the color of the outer panel surfaces (white) and the outer surface of lower portion 14 (also white).

In a first orientation of the jersey shown in FIG. 1, panels 22 and 24 are in an raised position covering the inner shell and being secured together over the shoulders by means of the "Velcro" tabs, so that the overall appearance of the jersey is that of the first color (white). By undoing the tabs, however, (FIG. 2), the jersey may be brought into a second orientation (FIG. 3) when the panels are moved to a lowered position wherein they hang down from the midriff section, thereby exposing their inner surfaces and the outer surface of shell 20. In this position, the panels substantially cover the lower portion of the garment, and the first color (white) of the jersey is accordingly substantially obscured. The jersey thus assumes its second color (blue) and conveniently portions 22 and 24 of the panels may be tucked into the wearer's shorts.

Figure 3:
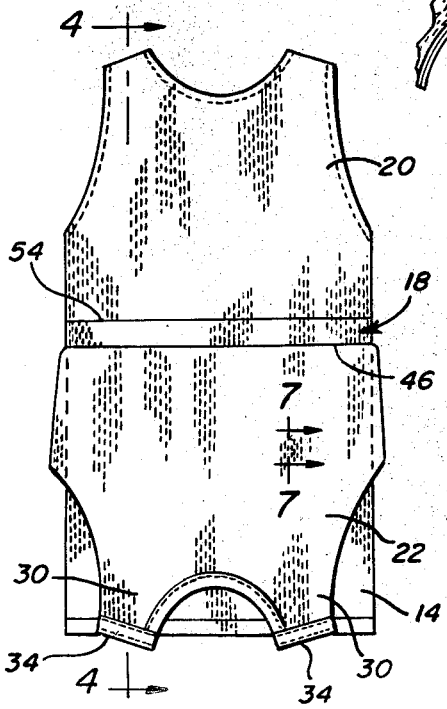
FIG. 3 is a front elevational view of the jersey in its second orientation.

To reconvert the jersey to its original color, it will be appreciated that it is simply necessary to lift panels 22 and 24 from the position shown in FIG. 3 and reattach them together over the shoulders with the "Velcro" tabs. Thus, conversion of the jersey from one color to the other is a simple operation in either case, involving only release of the tabs and lowering of the panels on the one hand, or raising of the panels and attachment of the tabs on the other hand.

A preferred construction of the jersey is illustrated by way of example, with particular reference to FIGS. 4–7.

In one form, as illustrated, the jersey may be made from vented lightweight cloth (for example, Nylon) of a type commonly used in athletic jerseys. As seen most clearly in FIG. 5, the lower portion 14 of the jersey may be formed from a single layer of such cloth in the requisite color (white). Portion 14 may, for example, be formed from two pieces of cloth 40, 42 which are seamed together on the sides of jersey and which have a conventional hem 44. Moreover, the pieces 40, 42 may be extended upwardly so as to form outer layers of the respective panels 22, 24. Additional pieces of cloth 46, 48 in the second color (blue) form inner layers of panels 22, 24 these being suitably seamed to the outer layers around the peripheral margins thereof, and also being seamed at 47 around the midriff region to cloth pieces 40, 42. Cloth pieces 46, 48 terminate at the midriff region and are there seamed (at 54) to further cloth pieces 50, 52 in the second color (blue) and which form the inner shell 20. The inner shell is thus also of single-layer construction and is suitably seamed up the sides and along the shoulders.

Seam 47 defines a junction between the lower and upper portions of the jersey about which the panels fold when converting from one orientation to the other. Tabs 34, 36 may be attached to their relevant shoulder pieces in conventional manner, as by sewing, and both the inner and outer shells of the upper portion may have conventional neck and armhole hems as shown.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An athletic upper-body garment comprising inner and outer shells for embracing a shoulder, back, and chest area of a wearer, the shells being integrated around a midriff section of the garment, the outer shell comprising a front panel and a rear panel, the panels being movable between a raised position wherein the panels substantially cover the inner shell and a lowered position wherein the panels hang down from the midriff section, the garment presenting a first characteristic outer surface appearance when the panels are in raised position and a second characteristic outer surface appearance when the panels are in lowered position, and the garment further including means for releasably retaining the panels in the raised position.

2. A garment as defined in claim 1 wherein the panels are separated at respective shoulder portions thereof, and the retaining means comprises means for releasably attaching the shoulder portions of the panels together over the shoulders of a wearer.

3. A garment as defined in claim 1 wherein said first and second characteristic appearances differ by color.

4. A garment as defined in claim 3 wherein each panel when in the raised position comprises inner and outer surfaces, the outer surfaces having a first characteristic color and the inner surfaces as well as the inner shell having a second characteristic color.

5. A garment as defined in claim 4 which includes a lower portion depending from the midriff section and integrated with said shells, said panels when in the lowered position at least partly covering said lower portion, and said lower section being of the first color.

6. A garment as defined in claim 5 wherein each panel, when in the raised position, comprises inner and outer layers, each outer layer as well as said lower portion being formed of cloth of the first color, and each inner layer as well as the inner shell being formed of cloth of the second color.

7. A garment as defined in claim 6 wherein said outer layers comprise extensions of pieces of cloth forming said lower portion.

8. A garment as defined in claim 7 wherein said pieces of cloth are seamed around the midriff section of the garment to the inner layers of the respective panels.

9. A garment as defined in claim 2 wherein said means for releasably attaching the panels together comprises friction-type attachment tabs secured to the shoulder portions of the respective panels.

10. A garment as defined in claim 1 wherein the panels are integrated together from the midriff section up to positions defining armhole openings of the outer shell.

* * * * *